US005419570A

United States Patent [19]

Bollotté

[11] Patent Number: 5,419,570

[45] Date of Patent: May 30, 1995

[54] SKATEBOARD HAVING SINGULAR IN LINE WHEELS

[76] Inventor: Guy O. Bollotté, HCR 73 Box 30194, Pahrump, Nev. 89041-9333

[21] Appl. No.: 93,019

[22] Filed: Jul. 19, 1993

[51] Int. Cl.[6] ..... A63C 17/06

[52] U.S. Cl. ..... 280/47.041; 280/11.22; 280/87.042; 280/11.27

[58] Field of Search ..... 280/11.22, 11.27, 11.28, 280/87.041, 87.042, 11.19, 11.23, 7.13, 842

[56] References Cited

U.S. PATENT DOCUMENTS

| | | | |
|---|---|---|---|
| D. 250,610 | 12/1978 | Wynn | D34/15 |
| D. 264,105 | 4/1982 | Dinnocente | D21/81 |
| D. 302,994 | 8/1989 | Hawkes et al. | D21/227 |
| 2,048,916 | 7/1936 | Bentzlin | 280/11.22 |
| 2,644,692 | 7/1953 | Kahlert | 280/11.22 |
| 3,282,598 | 11/1966 | Goodwin | 280/11.22 |
| 3,403,919 | 10/1968 | Weibling | 280/11.22 |
| 3,622,172 | 11/1971 | Goodwin | 280/11.22 |
| 3,751,062 | 8/1973 | White, Sr. | 280/87.04 |
| 3,923,316 | 12/1975 | Birnbaum | 280/11.22 |
| 4,093,252 | 6/1978 | Rue | 280/87.042 |
| 4,145,065 | 3/1979 | Kupka | 280/87.4 |
| 4,460,187 | 7/1984 | Shimuzu | 280/87.042 |
| 4,807,896 | 2/1989 | Philippi | 280/87.042 |
| 4,991,066 | 2/1991 | McLowan | 280/87.042 |
| 4,997,196 | 3/1991 | Wood | 280/87.042 |
| 5,160,155 | 11/1992 | Barachet | 280/87.042 |

FOREIGN PATENT DOCUMENTS 801256 12/1950 Germany ..... 280/7.13

*Primary Examiner*—Richard M. Camby

*Attorney, Agent, or Firm*—Robert A. Shack; David L. Baker; Rhodes & Ascoullo

[57] ABSTRACT

A skateboard for propulsion by the leg motion of a rider thereof, the skateboard including a platform for supporting the rider of the skateboard, the platform having a longitudinal axis, and a plurality of wheels, the plurality of wheels being disposed sequentially along the longitudinal axis of the platform, each of the plurality of wheels including a singular wheel, the plurality of singular wheels including at least six singular wheels, the plurality of singular wheels being substantially equally spaced at about 3½ inch intervals, the platform being substantially about two feet in length, measured along the longitudinal axis of the platform, and the platform being substantially about nine inches in width, measured transverse to the longitudinal axis of the platform. Preferably, the platform has a front end and a rear end, the skateboard may alternatively include a handle member extending upward from the front end of the platform, the skateboard, may alternatively include at least one of a light source and a reflector mounted on the front end of the platform, and the skateboard may alternatively include at least one of a light source and a reflector mounted on the rear end of the platform.

3 Claims, 3 Drawing Sheets

SKATEBOARD HAVING SINGULAR IN LINE WHEELS

BACKGROUND

1. Field of the Invention

The present invention relates to the field of skateboards, that is a low platform having wheels mounted thereunder that may be propelled by the feet of the rider. In an alternative embodiment, an upwardly projecting handle portion converts the skateboard into a scooter.

Few sports items have achieved greater popularity with children and teenagers in the last few years than skateboards. The skateboard disclosed herein provides a new level of difficulty and excitement, even for skateboard experts.

2. Description of the Related Art

U.S. Pat. No. 4,145,065 relates to a roller skate type scooter having an articulated support platform with pivotally connected forward and rearward footboards at least one wheel secured to the underside of each footboard, and a steering assembly mounted upon the front footboard for maneuvering the first footboard generally in a horizontal plane about a pivot point.

U.S. Pat. No. 3,751,062 relates to a scooter skateboard having a platform and a removable handle mounted firmly on one end of the platform for assisting novice riders in gaining practice.

U.S. Pat. Nos. Des. 302,994, 264,105, and 250,610 relate to ornamental designs for skateboard scooters.

SUMMARY OF THE INVENTION

In one aspect, the invention generally features a skateboard for propulsion by the leg motion of a rider thereof, the skateboard including: a platform for supporting the rider of the skateboard, the platform having a longitudinal axis; and a plurality of wheels disposed sequentially in a line along the longitudinal axis of the platform; each of the plurality of wheels including a singular wheel.

Preferably, the plurality of singular wheels includes at least six singular wheels; the plurality of singular wheels are substantially equally spaced at about 3½ inch intervals; the platform is substantially about two feet in length, measured along the longitudinal axis of the platform, and the platform is substantially about nine inches in width, measured transverse to the longitudinal axis of the platform; the platform has a front end and a rear end, and the skateboard additionally includes a handle member extending upward from the front end of the platform; and the skateboard additionally includes at least one of a light source and a reflector mounted on the front end of the platform, and at least one of a light source and a reflector mounted on the rear end of the platform.

In an alternative embodiment of the invention, the plurality of singular wheels includes at least eight singular wheels.

In another aspect, the invention generally features a skateboard for propulsion by the leg motion of a rider thereof, the skateboard including: a platform for supporting the rider, the platform having a longitudinal axis; and a plurality of sequentially spaced singular wheels disposed substantially in line along the longitudinal axis of the platform.

Preferably, the plurality of singular wheels includes at least six singular wheels, and the plurality of singular wheels are substantially equally spaced at about 3½ inch intervals; alternatively, the plurality of singular wheels includes at least eight singular wheels, and the plurality of singular wheels are substantially equally spaced at about 3½ inch intervals.

In another aspect, the invention generally features a skateboard for propulsion by the leg motion of a rider thereof, the skateboard including: a platform for supporting the rider of the skateboard, the platform having a longitudinal axis; and a plurality of wheels, the plurality of wheels being disposed sequentially along the longitudinal axis of the platform; each of the plurality of wheels including a singular wheel; the plurality of singular wheels including at least six singular wheels; the plurality of singular wheels being substantially equally spaced at about 3½ inch intervals; the platform being substantially about two feet in length, measured along the longitudinal axis of the platform; and the platform being substantially about nine inches in width, measured transverse to the longitudinal axis of the platform.

Preferably, the platform has a front end and a rear end, the skateboard additionally includes a handle member extending upward from the front end of the platform, the skateboard additionally includes at least one of a light source and a reflector mounted on the front end of the platform, and the skateboard additionally includes at least one of a light source and a reflector mounted on the rear end of the platform. Alternatively, the plurality of singular wheels includes at least eight singular wheels.

One object of the present invention is the provision of a skateboard that is more challenging and exciting to ride than those currently known.

Another object of the invention is the provision of such a skateboard that can be converted into a scooter having a front handle, thereby accommodating less experienced riders.

Yet another object of the invention is the provision of a skateboard/scooter having a front and/or rear headlight/reflector.

The invention will now be described by way of a particularly preferred embodiment, reference being made to the accompanying drawings, wherein:

DESCRIPTION OF THE PREFERRED EMBODIMENT

Figures 1, 2, 3, 4:
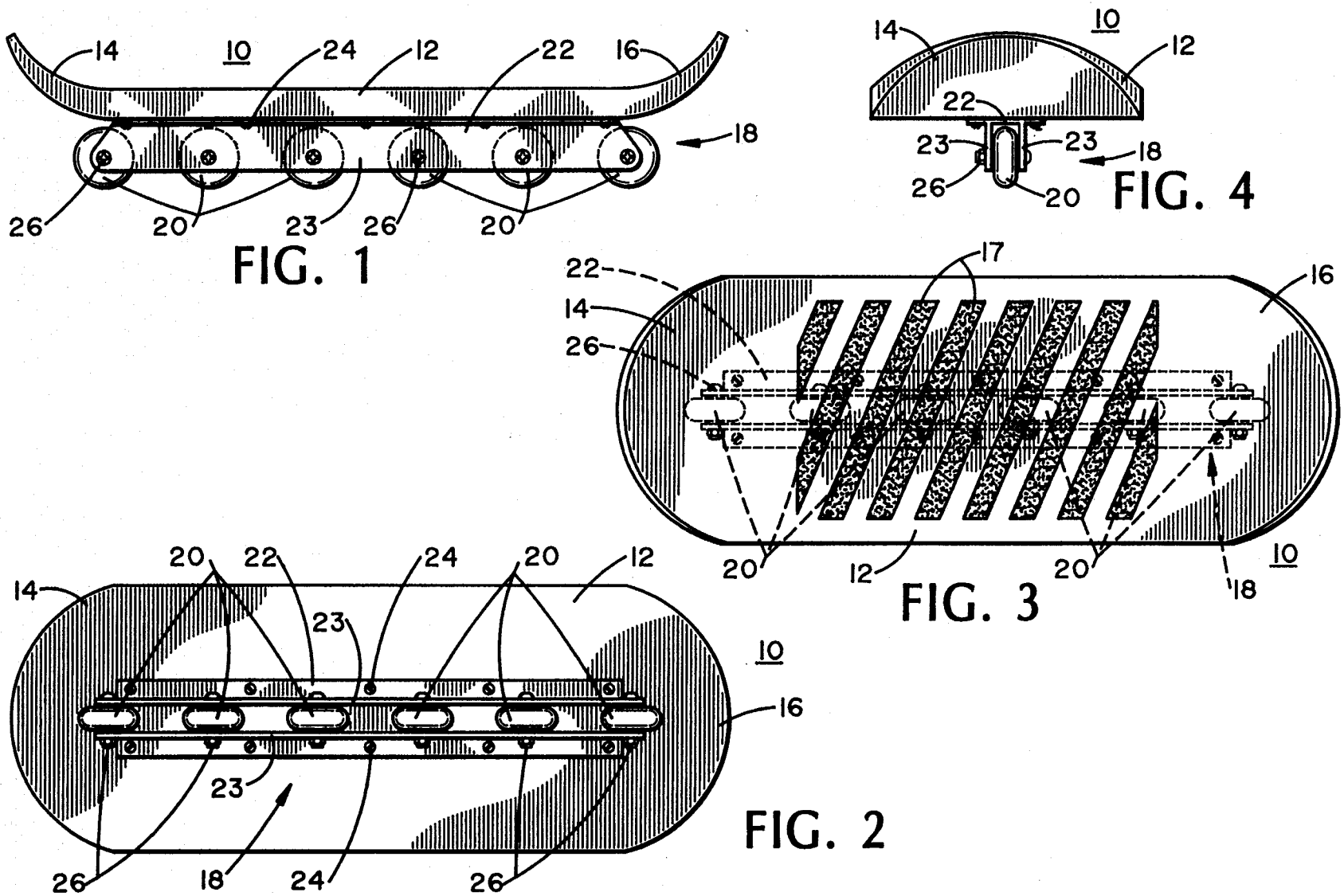
FIG. 1 is a side elevational view of a skateboard having singular in line wheels constructed according to the present invention.
FIG. 2 is a bottom plan view of the inventive skateboard of FIG. 1.
FIG. 3 is a top plan view of the inventive skateboard.
FIG. 4 is a front elevational view of the inventive skateboard.

Referring initially now to FIGS. 1–4, a skateboard 10 constructed according to the present invention generally includes a platform 12, upon which a rider of the skateboard 10 balances and, using a kicking leg motion, propels the skateboard 10 as desired. Preferably, the platform 12 has an upwardly turned front portion 14 and an additional upwardly turned rear portion 16 that assist the rider in steering the skateboard and performing various maneuvers therewith. Additionally, as shown in FIG. 3, the upper surface of the platform 12 is preferably provided with slanted bands 17 of a slip resistant surfacing material, of a variety of types well known in the art, to aid the rider in maintaining his position on the skateboard 10.

The skateboard 10 additionally includes a wheel assembly 18 mounted to the underside of the platform 12. As is seen .most clearly in FIGS. 2, 3, and 4, the wheel assembly 18 consists of a plurality of sequentially spaced singular wheels 20 positioned substantially in a line along the longitudinal axis of the platform 12. In the preferred embodiment shown in FIGS. 1–4, preferably six such sequentially spaced singular wheels 20 are mounted substantially in a line beneath the platform 12.

The wheel assembly 18 also includes a bracket member 22 that is secured to the underside of the platform 12 by screws 24 passing through a horizontal flange thereof. The bracket member 22 has a pair of transversely spaced and downward extending flanges 23, between which the singular wheels 20 are positioned, rotationally mounted on axles 26 extending therebetween.

Figure 5:
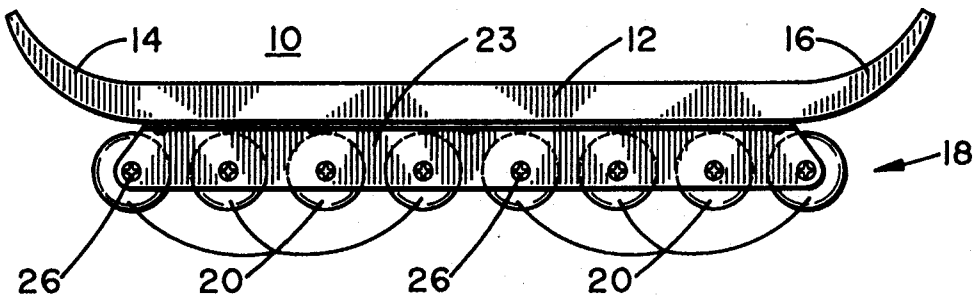
FIG. 5 is a side elevational view of an alternative embodiment of the invention, wherein a skateboard constructed according to the invention is provided with eight in line singular wheels.

An alternative embodiment of the invention is shown in FIG. 5, wherein the skateboard 10 is provided with eight in line singular wheels 20, like reference numerals being used to identify similar elements to those already described above.

Figure 6:
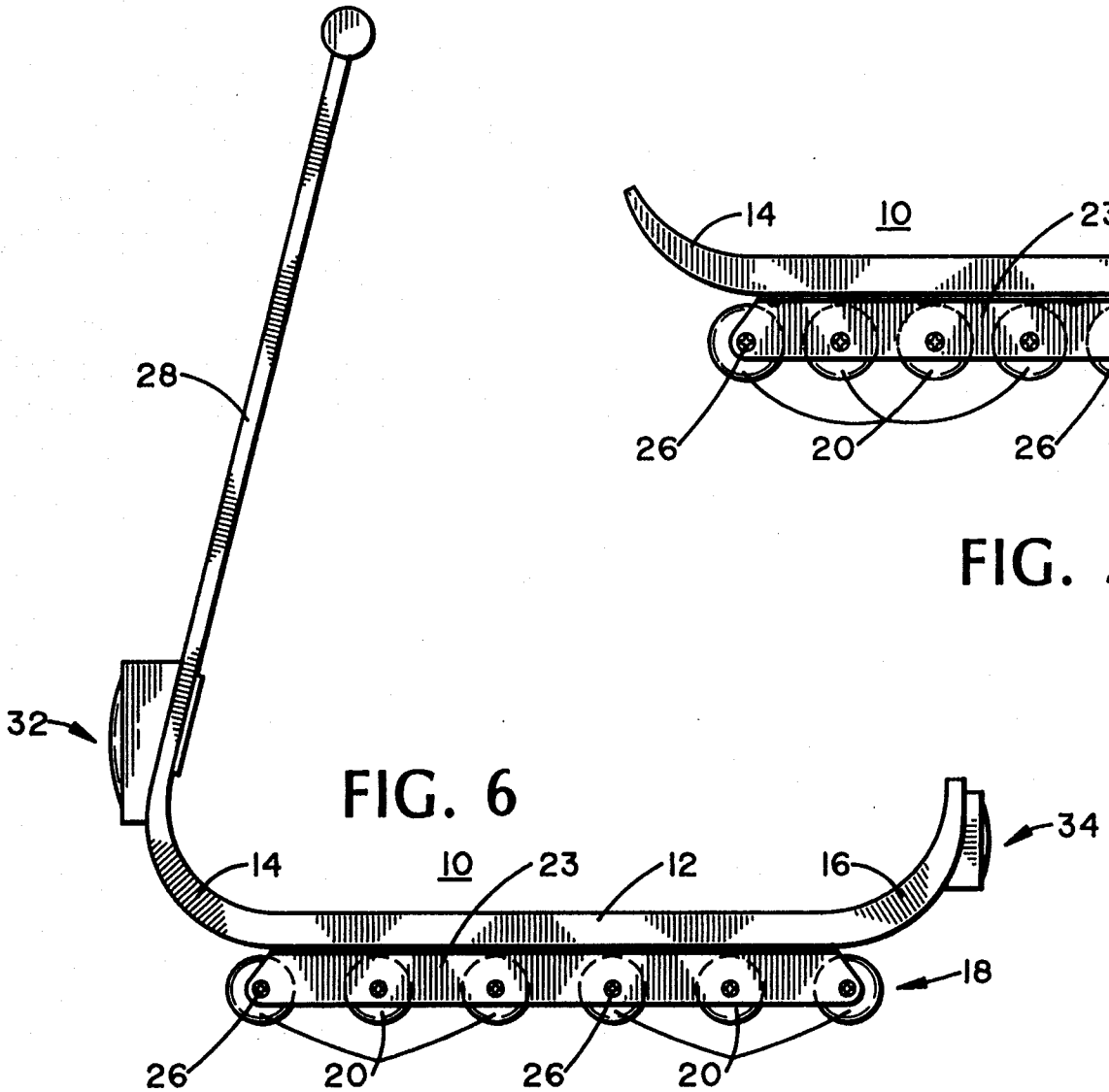
FIG. 6 is a side elevational view of another alternative embodiment of the invention, wherein a skateboard constructed according to the invention is provided with an upwardly extending handle portion, as well as with both front and back headlight/reflectors.
Figure 8:
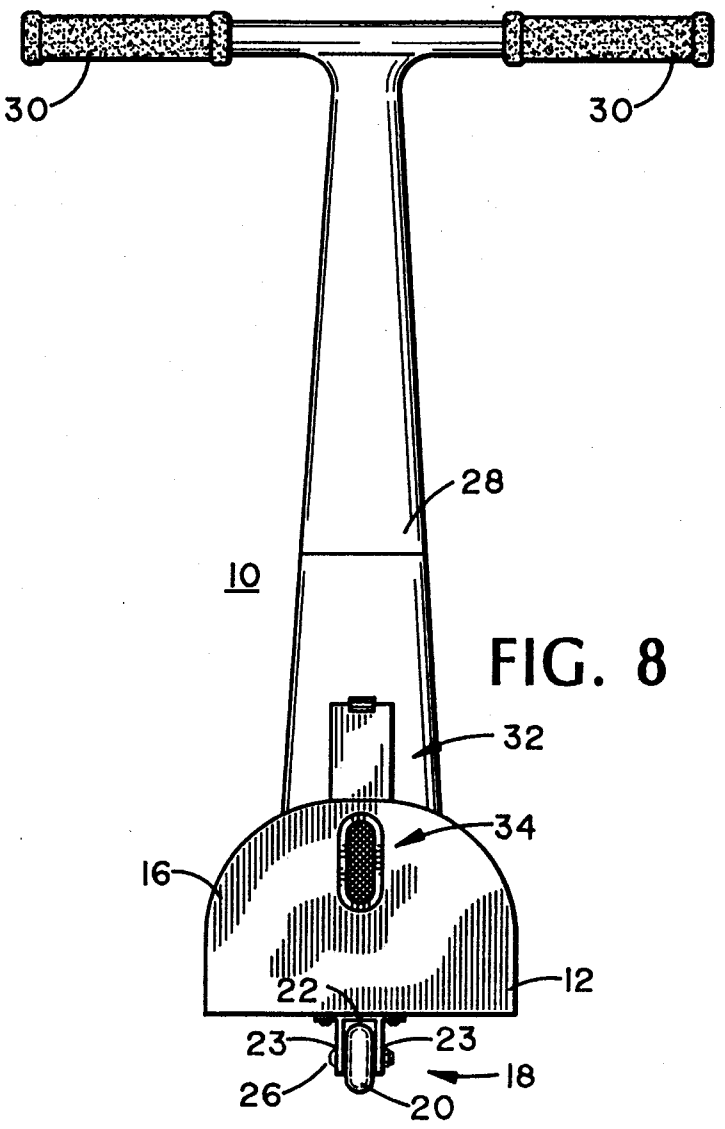
FIG. 8 is a rear elevational view of the inventive skateboard of FIGS. 6 and 7.
Figure 7:
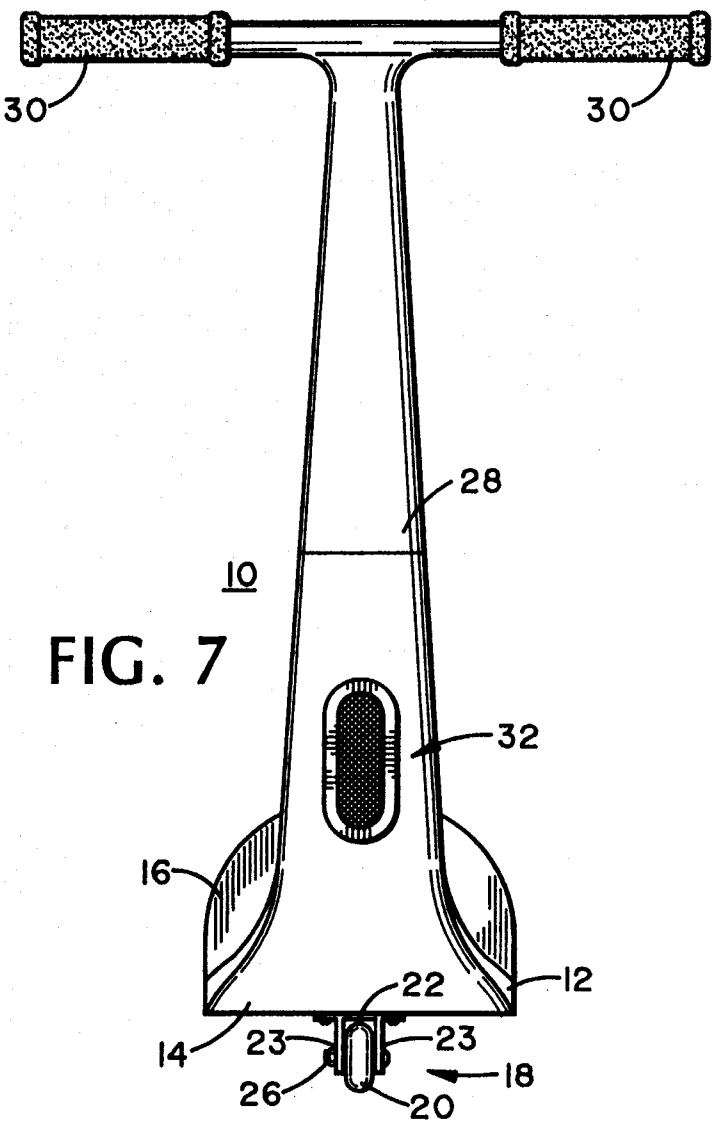
FIG. 7 is a front elevational view of the inventive skateboard of FIG. 6.

Another alternative embodiment of the invention is illustrated in FIGS. 6–8, wherein like reference numerals are likewise used to identify similar elements to those already described above. In the embodiment of FIGS. 6–8, the skateboard 10 is provided with a handle 28 that extends upward from the front portion of the platform 12 and is, preferably, a continuing extension of the upwardly turned front portion 14 described above. The handle 28, as seen most clearly in FIGS. 7 and 8, is generally T-shaped, and has outwardly extending grip members 30. Preferably, either a light, a reflector or a combination thereof 32 is mounted on the forward surface of the handle 28 for increasing the visibility of the skateboard 10 in dim light situations. Additionally, a further light, reflector, or a combination light/reflector 34 may be preferably mounted on the rear surface of the upwardly turned rear portion 16 for a like purpose.

The unique configuration of the wheel assembly described herein, namely a plurality of singular wheels positioned substantially in line, preferably either six of eight wheels, offers a challenge to even the most skilled skateboard riders. Moreover, the embodiment in which the handle 28 is provided, in essence, converts the skateboard 10 into a scooter, and allows less skilled riders to use the invention as they increase their abilities. Still further, the skateboard 10 may be equipped with light/reflectors, as described above, to increase the visibility of the rider in dim light situations.

While the invention has been herein described by way of a particular preferred embodiment, various substitutions of equivalents may be effected without departing from the spirit and scope of the invention as set forth in the following claims.

What is claimed is:

1. A skateboard for propulsion by leg motion of a rider thereof, said skateboard comprising:

(a) a platform for supporting the rider of said skateboard, said platform comprising:
- a front;
- a rear;
- an upper surface;
- an underside;
- an upwardly turned front portion, disposed at the front of the platform;
- an upwardly turned rear portion, disposed at the rear of the platform; and
- at least one of a light source and a reflector mounted on said upwardly turned rear portion;

(b) said platform being substantially about two feet in length measured from the rear to the front of said platform, and wherein said platform is substantially about nine inches in width, measured midway between the rear and the front of said platform;

(c) said platform is formed from one continuous piece of material;

(d) said platform is substantially about two feet in length measured from the rear to the front of said platform, and wherein said platform is substantially about nine inches in width, measured midway between the rear and the front of said platform;

(e) a handle member extending upward from said upwardly turned front portion of said platform;

(f) said handle member is an integrally continuous extension of said upwardly turned front portion;

(g) said handle member is generally T-shaped, said handle member including:
- a substantially vertical handle support having one end fixedly attached to the upwardly turned front portion of said platform; and
- two substantially horizontal outwardly extending grip members fixedly attached to said vertical handle support;

(h) at least one of a light source and a reflector mounted on said handle member;

(i) a wheel assembly attached to the underside of said platform, said wheel assembly comprising:
- a bracket member, fixedly secured to the underside of said platform along a centerline of said platform, the centerline extending from the rear to the front of said platform, said bracket member comprising:
  - a horizontal flange fixedly secured to the underside of said platform;
  - a first downwardly extending flange;
  - a first plurality of axle receiving ports sequentially disposed in said first downwardly extending flange, each of said first plurality of axle receiving ports extending through said first downwardly extending flange;
  - a second downwardly extending flange;
  - a second plurality of axle receiving ports sequentially disposed in said second downwardly extending flange, each of said second plurality of axle receiving ports extending through said second downwardly extending flange; and said first and said second downwardly extending flanges being transversely spaced from one another and straddling the centerline of said platform such that said first and said second plurality of axle receiving ports are matingly disposed from each other across the centerline of said platform;

a plurality of axles, each of said plurality of axles being fixedly disposed in a mating pair of first and second axle receiving ports, each of said plurality of axles lying orthogonally transverse to the centerline; and a plurality of singular wheels, one each of said plurality of wheels being rotatably mounted on one respective axle of said plurality of axles, said plurality of singular wheels are substantially equally spaced at about 3½ inch intervals; and (j) a plurality of bands of slip resistant surfacing material disposed upon the upper surface of said platform, said plurality of bands of slip resistant material to provide a slip resistant support for the rider.

2. A skateboard according to claim 1, wherein said plurality of singular wheels comprises at least six singular wheels.

3. A skateboard according to claim 1, wherein said plurality of singular wheels comprises at least eight singular wheels.

* * * * *